US011674782B1

(12) United States Patent
Manley et al.

(10) Patent No.: US 11,674,782 B1
(45) **Date of Patent: *Jun. 13, 2023**

(54) PISTON ACTUATED EXTENDED RANGE PROJECTILE WITH SEGMENTED SLIP BAND

(71) Applicant: U.S. Government as Represented by the Secretary of the Army, Dover, NJ (US)

(72) Inventors: David Chalfant Manley, Budd Lake, NJ (US); Sean Mulvihill, Lake Hiawatha, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/407,448

(22) Filed: Aug. 20, 2021

Related U.S. Application Data

(60) Provisional application No. 63/071,685, filed on Aug. 28, 2020.

(51) Int. Cl.
*F42B 14/06* (2006.01)
*F42B 7/08* (2006.01)
*F42B 10/36* (2006.01)

(52) U.S. Cl.
CPC ..... *F42B 14/065* (2013.01); *F42B 14/064* (2013.01); *F42B 14/067* (2013.01); *F42B 10/36* (2013.01)

(58) Field of Classification Search
None
See application file for complete search history.

(56) References Cited

U.S. PATENT DOCUMENTS 44,353 A * 9/1864 Tripp ..... F42B 10/40 102/490
1,040,859 A 10/1912 Blair
2,382,152 A * 8/1945 Jakobsson ..... F42B 14/064 89/14.6
2,461,555 A * 2/1949 Linsley ..... F42B 12/64 102/456
2,638,051 A * 5/1953 Critchfield ..... F42B 14/064 102/522
2,669,930 A * 2/1954 Darbypaulf ..... F42B 14/064 102/523
2,715,874 A * 8/1955 Hablutzel ..... F42B 14/02 102/523
3,000,316 A * 9/1961 Dunlap ..... F42B 14/064 102/523
3,180,265 A 4/1965 Rybak
3,186,342 A * 6/1965 Hancock, Jr. ..... F42B 14/064 102/523

(Continued)

FOREIGN PATENT DOCUMENTS

GB 9419864 11/1994

*Primary Examiner* — Derrick R Morgan
(74) *Attorney, Agent, or Firm* — John P. DiScala

(57) ABSTRACT

A projectile delivers a pellet payload to an increased range with increased accuracy. A two piece aerodynamically stable pusher consists of a body and tailpiece. This pusher fits into a standard 40 mm cartridge case by means of three sabots. To seal against combustion gases, a three piece split rotating band is employed.

19 Claims, 2 Drawing Sheets

(56) References Cited

U.S. PATENT DOCUMENTS 3,349,712 A * 10/1967 Schwager ..... F42B 14/064 102/522
3,405,638 A * 10/1968 Stoner, Jr. ..... F42B 7/02 102/458
3,447,466 A * 6/1969 Engel ..... F42B 14/064 102/522
3,507,220 A * 4/1970 McClure ..... F42B 7/04 102/463
3,507,221 A * 4/1970 Grolly ..... F42B 14/064 102/518
3,568,603 A * 3/1971 Vartanian ..... F42B 7/06 102/456
3,724,378 A * 4/1973 Knight ..... F42B 12/64 102/448
3,730,095 A 5/1973 Lage
3,744,426 A * 7/1973 Butler ..... F42B 14/02 102/527
3,762,332 A 10/1973 Witherspoon
3,771,455 A * 11/1973 Haas ..... F42B 12/64 102/377
3,780,658 A * 12/1973 de Longueville ..... F42B 10/40 102/518
3,812,784 A 5/1974 Herter
3,877,383 A 4/1975 Flatau
3,919,799 A 11/1975 Austin
3,982,489 A 9/1976 Flatau
3,991,682 A 11/1976 Peak
4,000,698 A * 1/1977 Corney ..... F42B 14/064 102/522
4,036,141 A * 7/1977 Korr ..... F42B 5/035 102/443
4,154,012 A 5/1979 Miller
4,212,244 A 7/1980 Flatau
4,296,687 A * 10/1981 Garrett ..... F42B 14/064 102/518
4,389,939 A * 6/1983 Ofuji ..... F42B 7/04 102/458
4,476,785 A 10/1984 Hoffman
4,505,202 A * 3/1985 Fidler ..... F42B 14/06 102/357
4,505,204 A * 3/1985 Wikstrom ..... F42B 14/064 102/523
4,553,481 A * 11/1985 Ricci ..... F42B 7/08 102/458
4,590,862 A 5/1986 Grabarek
4,706,569 A * 11/1987 Wallow ..... F42B 12/06 102/521
4,726,298 A * 2/1988 Sigg ..... F42B 14/064 102/527
4,750,425 A 6/1988 Sigg
4,800,816 A * 1/1989 Meyer ..... F42B 14/064 102/523
4,841,867 A * 6/1989 Garrett ..... F42B 14/064 102/523
4,936,219 A * 6/1990 Mudd ..... F42B 10/06 102/520
5,012,744 A 5/1991 Sowash
5,239,928 A * 8/1993 Ricci ..... F42B 5/067 102/439
5,644,100 A * 7/1997 Puckett ..... F42B 7/08 102/449
5,834,682 A * 11/1998 Warren ..... F42B 5/15 102/505
5,969,289 A 10/1999 Bisping
6,105,506 A 8/2000 Gangale
6,701,848 B1 3/2004 Georgantzis
6,814,006 B2 * 11/2004 Johansson ..... F42B 14/068 102/522
7,228,801 B2 * 6/2007 Dunnam ..... F42B 12/38 102/458
7,243,603 B2 7/2007 Sheaffer
7,451,702 B1 * 11/2008 Dindl ..... F42B 12/62 102/438
8,511,232 B2 8/2013 Scarr
8,622,000 B2 1/2014 Meyer
8,887,641 B1 * 11/2014 Manole ..... F42B 14/06 102/521
9,360,223 B1 * 6/2016 Billings ..... F42B 7/04
9,528,806 B2 12/2016 Rossmann
9,658,038 B1 * 5/2017 Dunnam ..... F42B 7/08
10,422,611 B1 * 9/2019 Moser ..... F42B 7/08
10,584,947 B1 3/2020 Manley
2002/0088897 A1 * 7/2002 Davis ..... F42B 10/06 244/3.24
2004/0107826 A1 * 6/2004 Simmons ..... F41A 1/02 89/8
2010/0077934 A1 * 4/2010 Heitmann ..... F42B 14/064 102/523
2010/0212533 A1 * 8/2010 Brunn ..... F42B 7/02 102/502
2013/0145951 A1 * 6/2013 Nauman ..... F42B 7/04 102/448
2014/0155200 A1 * 6/2014 Flint ..... F42B 12/362 473/577
2015/0330754 A1 11/2015 Bierman
2017/0261292 A1 * 9/2017 Armstrong ..... F41H 11/02
2019/0162512 A1 * 5/2019 Pinoteau ..... F42B 14/02
2019/0301844 A1 * 10/2019 Garst ..... F42B 10/26
2020/0363176 A1 * 11/2020 Pigott ..... F41G 1/46

* cited by examiner

PISTON ACTUATED EXTENDED RANGE PROJECTILE WITH SEGMENTED SLIP BAND

CROSS-REFERENCE TO RELATED APPLICATIONS

This application claims the benefit under 35 USC § 119(e) of U.S. provisional patent application 63/071,685 filed on Aug. 28, 2020.

STATEMENT OF GOVERNMENT INTEREST

The inventions described herein may be manufactured, used and licensed by or for the United States Government.

FIELD OF THE INVENTION

The invention relates in general to munitions and in particular to payload delivering munitions.

BACKGROUND OF THE INVENTION

Traditional shotgun cartridges release their payload immediately after exiting the barrel. As the shot flies down range the shot column naturally spreads out as it travels down range. This results in a lower density of pellets at extended ranges, which reduces the probability of being able to deliver the intended effects to the target. These effects are even more prevalent when the cartridge is fired from a rifled barrel, like a traditional 40 mm weapon system.

In order to mitigate this issue in the past, attempts were made to release the pellets without disturbing the payload. Another approach utilized a pusher design in which the pusher flies an extended range before drag on the pusher causes it to pull off of the payload. However, these efforts still result in a limit effective range.

A need exists for an improved projectile which overcomes these limitations and increases the effective range of the projectile.

SUMMARY OF INVENTION

One aspect of the invention is a projectile further comprising a pusher assembly, a payload, a cap, a plunger, a sabot assembly and a segmented slip band. The pusher assembly further comprises a pusher body defining an interior housing, and a pusher tail connected to the rear of the pusher body. The payload is housed within the pusher body. The cap is connected to the front of the pusher body for retaining the payload within the pusher body prior to ejection. The plunger is housed within the rear of the pusher body and is configured for pushing the cap off the pusher body. The sabot assembly is coaxial with and partially surrounding the pusher assembly. The segmented slip band is coaxial with and seated in a groove on an exterior of the sabot assembly. The segmented slip band rotates freely within the groove thereby minimizing the spin imparted on the pusher body and separates into one or more segments upon exit from a weapon system.

Another aspect of the invention is a forty millimeter projectile further comprising a pusher assembly, a pellet payload, a cap, a plunger, a rubber pad, a sabot assembly and a segmented slip band. The pusher assembly further comprises a pusher body defining an interior housing and a pusher tail connected to the rear of the pusher body. The pellet payload is housed within the pusher body. The cap is snap fit connected to the front of the pusher body for retaining the payload within the pusher body prior to ejection. The plunger is housed within the rear of the pusher body and configured for pushing the cap off the pusher body. The plunger further comprises a face exposed to the breech of the weapon system and a shaft extending toward the cap. The rubber pad is positioned at the rear of the payload. The sabot assembly is coaxial with and partially surrounding the pusher assembly. The segmented slip band is coaxial with and seated in a groove on an exterior of the sabot assembly. The segmented slip band rotates freely within the groove thereby minimizing the spin imparted on the pusher body and separates into one or more segments upon exit from a weapon system. The segmented slip band further comprises a groove for receiving a corresponding protrusion of a cartridge case to hold the segmented slip band in place prior to being fired.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A projectile delivers a pellet payload to an increased range with increased accuracy. A two-piece aerodynamically stable pusher consists of a body and tail. This pusher fits into a standard 40 mm cartridge case by means of three sabots. To seal against combustion gases, a three piece split rotating band is employed. To allow for the integration of a segmented slip band, the slip band features a crimp groove, which allows the cartridge case to hold them in place before for the projectile is fired.

This band is instrumental in increasing the effective range of the pellets. By decoupling the aerodynamic pusher from the rotating band, spin up in the barrel can be minimized. This reduction in rotation results in less centripetal force imparted to the pellets which, in turn, allows the pellets to hold a tighter pattern upon exiting the pusher. The segmented slip bands also reduce the amount of blow-by by engaging the rifling.

The slip band also increases the reliability of the projectile in a low velocity system. Traditionally, slip bands are a single piece, which the force of the sabot breaks after the projectile leaves the muzzle. However, in a lower velocity environment, like a 40 mm platform, the segmented design gives the same benefit of reducing the spin imparted to the projectile while also allowing the sabots and slip band to release more cleanly and easily from the pusher thereby reducing disturbance to the pusher. This also increases the reliability of the release of the sabots.

Upon ignition of the propellant, the combustion gases pressurize the chamber at the rear of the pusher. The pressure acts on a plunger that travels forward in the bore of the pusher. The other end of the plunger acts on the sealing cap at the front of the round. Within a few milliseconds of propellant ignition, the cap is forced off and the pusher travels downrange with the pellets now free to exit the pusher as the velocity difference between pusher and pellets increases.

This approach to removing the cap allows for the cap to be discarded immediately after the projectile is fired and also dramatically reduces the weight of the sabots since they are no longer needed to extend to the front of the pusher body to hold a lid. In addition, since the cartridge pressure is utilized to push the cap off the pusher body, the cap can be made more tamper resistant.

Those skilled in the art will recognize that the projectile can also be adapted for use with other lower velocity applications besides 40 mm calibers, such as small caliber ammunition up through large caliber ammunition.

Figure 1:
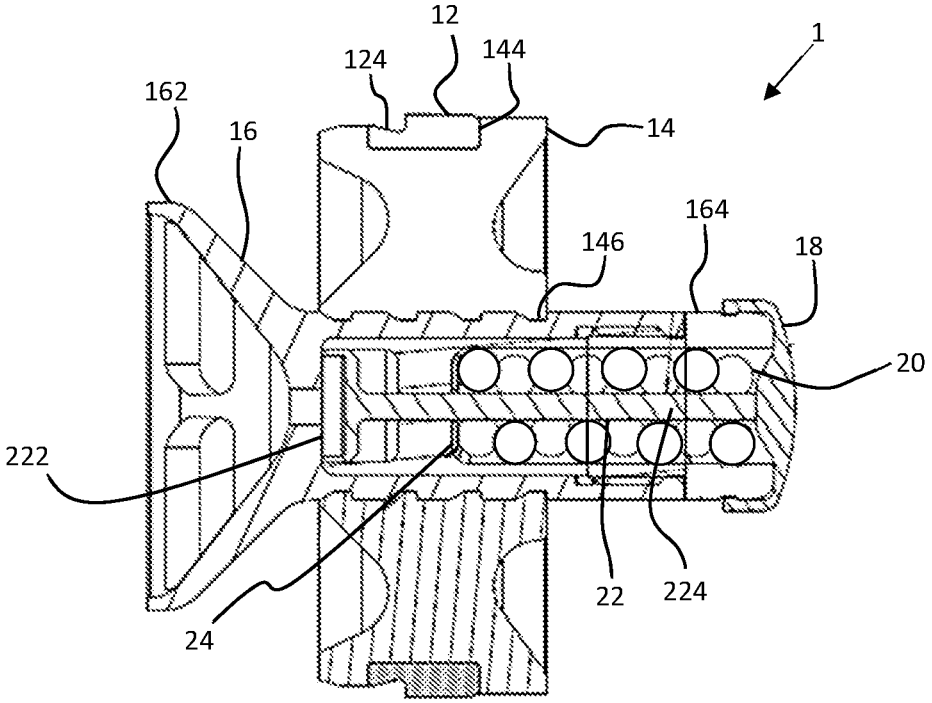
FIG. 1 is a cross-sectional view of a projectile, according to an illustrative embodiment.
Figure 2:
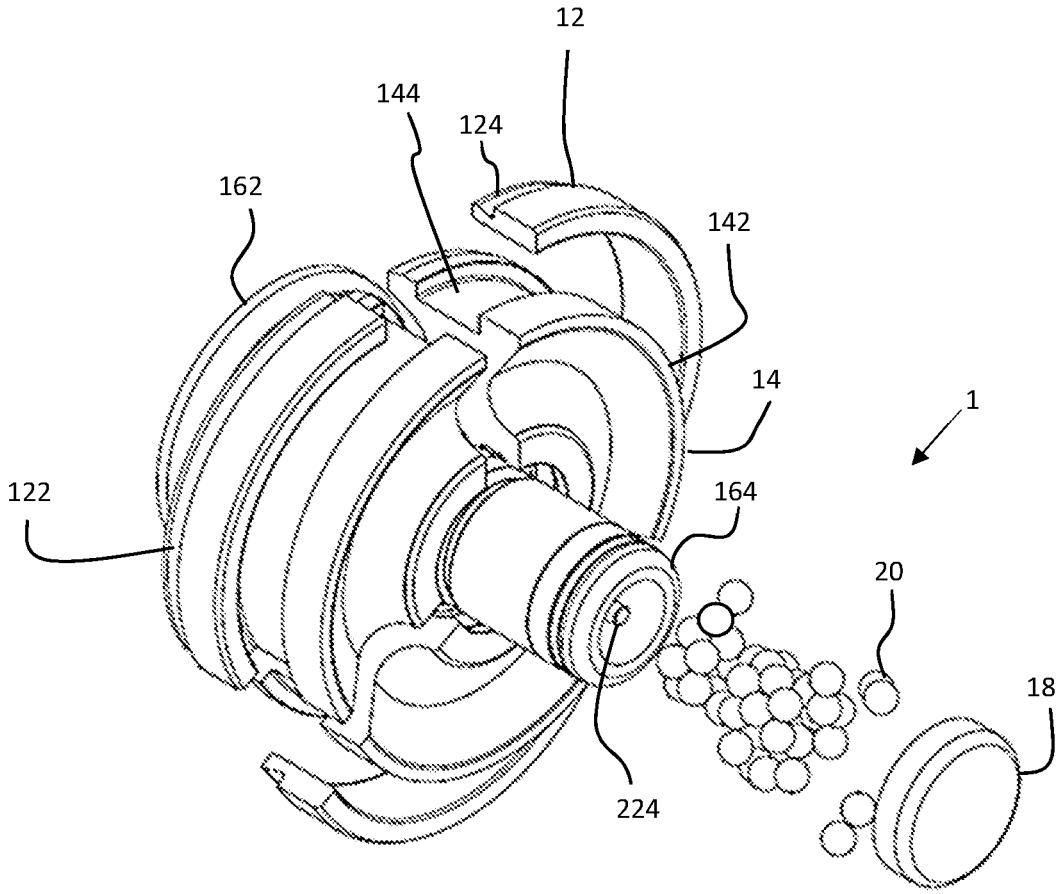
FIG. 2 is an exploded view of a projectile, according to an illustrative embodiment.

FIG. 1 is a cross-sectional view of a projectile, according to an illustrative embodiment. FIG. 2 is an exploded view of a projectile, according to an illustrative embodiment. The projectile 1 further comprises a segmented slip band 12, a sabot assembly 14, a pusher 16, a cap 18, a payload 20, a plunger 22 and a pad 24. The pusher 16 further comprises a pusher tail 162 and a pusher body 164.

The segmented slip band 12 is seated around the exterior of the sabot assembly 14 in a groove. The segmented slip band 12 further comprises a plurality of segments which together form a slip band. The segments are in contact but not mechanically connected to each other.

The segmented slip band 12 allows the projectile to fully seal in the rifling of the weapon system barrel in order to reduce blow by and to utilize the propellant efficiently. In addition, the segmented slip band 12 reduces the spin imparted to the pusher 16 in order to reduce the spread of the payload 20 at extended ranges.

Further, the segmented slip band 12 also allows for a low velocity, reliable discard of the slip band 12 and sabot assembly 14 without reducing the forward momentum or disturbing the pusher 16. As the projectile exits the gun barrel, the segments 122 of the segmented slip band 12 separate and travel outward from the sabot assembly 14 without requiring the sabot assembly 14 to impart force to break them apart.

To allow for the integration of a segmented slip band 12, the slip band 12 features a crimp groove 124, which allows the cartridge case to hold them in place before for the projectile is fired. The crimp groove 124 extends around the exterior circumference of the segmented slip band 12. When the projectile is seated in a cartridge case, the cartridge case is crimped at the crimp groove 124 thereby holding the segmented slip band 12 in place until the cartridge is fired. Once the cartridge is fired, the cartridge case no longer restrains the segmented slip band 12 and the segmented slip band 12 is constrained by the sabot groove and the barrel. The segmented slip band is free to separate upon leaving the weapon barrel.

The sabot assembly 14 is comprised of one or more sabots 142 and extends circumferentially around the pusher tail 162. The sabots 142 feature a groove 144 extending around the external circumference to allow the slip band 12 to freely rotate, while minimizing the amount of spin imparted to the rest of the projectile. The sabots 146 also feature grooves 146 extending around their internal circumference to allow the sabots 146 to interface with the pusher tail 162. As described above, the sabot assembly 14 need not extend to the front of the projectile due to the use of a cap 18 which attaches to the pusher body 164 without the sabot assembly 14. The relatively short length of the sabots 142 are selected to reduce the overall mass of the projectile 1 and allow for increased muzzle velocities, while still remaining under the recoil limit of the weapon system.

The sabot assembly 142 is held in place by the crimped segmented slip band 12 and the interface features 146 with the pusher 16. Upon the segmented slip band 12 separating after muzzle exit, the sabot assembly 14 also separates.

In the embodiment shown, the segmented slip band 12 is comprised of three sections 124 and the sabot assembly 14 is comprised of three sabots 142. However, in other embodiments, the segmented slip band 12 and sabot assembly 14 may be comprised of more than three components or less than three components.

The pusher 16 serves as the main structure of the projectile 1 and is comprised of the pusher body 164 and the pusher tail 162. The pusher tail 162 creates an aerodynamic shape for the projectile 1 and also features interfaces for the sabots 142 and the pusher body 164. The shape, and therefore drag profile, of the pusher tail 162 can be adjusted in order to increase or reduce the drag force on the projectile 1 thereby allowing for tailoring of a payload distance, where the payload 20 exists the pusher body 164.

The pusher body comprises an internal housing which houses the payload 20 and defines a cavity for the plunger to ride in. The pusher body 164 interfaces with the pusher tail 162, and provides an attachment point for the cap 18. Further, the pusher body 164 provides structure and support for the projectile 1 as a whole.

The cap 18 attaches to the front of pusher body 164 with a snap fit. In other embodiments, the cap 18 could also be affixed to the pusher body 164 through other means such as threads, adhesives, molding or other means. The cap 18 retains the payload 20 inside of the pusher body 164 until the projectile 1 is fired.

The payload 20 is housed within the pusher body 164 and retained by the cap 18. The projectile 1 is particularly suited to deliver a payload 20 which is not unitary. The payload 20 could consist of steel pellets, tungsten pellets, plastic pellets, rubber pellets, powders, streamers, or any other payload that would be delivered to a target.

The plunger 22 is disposed within the pusher body 164 with a face 222 to the rear of the pusher body 164 and a shaft 224 extending forward toward the cap 18. The propellant gasses push on the face 222 of the plunger 22 driving it forward until the shaft 224 pushes the cap 18 off of the pusher body 164. The pusher body 164 defines a cavity for the plunger 22 to ride in and seal against to create a gas seal, which keeps the propellant gasses from entering into the pellet cavity.

While the invention has been described with reference to certain embodiments, numerous changes, alterations and modifications to the described embodiments are possible without departing from the spirit and scope of the invention as defined in the appended claims, and equivalents thereof

What is claimed is:

1. A projectile further comprising:

a pusher assembly further comprising a pusher body defining an interior housing, and a pusher tail connected to the rear of the pusher body;

a payload housed within the pusher body;

a cap connected to the front of the pusher body for retaining the payload within the pusher body prior to ejection;

a plunger housed within the rear of the pusher body and configured for pushing the cap off the pusher body;

a sabot assembly coaxial with and partially surrounding the pusher assembly; and a segmented slip band coaxial with and seated in a groove on an exterior of the sabot assembly, wherein the segmented slip band rotates freely within the groove thereby minimizing the spin imparted on the pusher body and the segmented slip band separates into one or more segments upon exit from a weapon system.

2. The projectile of claim 1 wherein the segmented slip band separates from the sabot assembly upon exiting a gun barrel without the sabot assembly imparting force to break the segmented slip band apart.

3. The projectile of claim 1 wherein the segmented slip band further comprises a groove for receiving a corresponding protrusion of a cartridge case to hold the segmented slip band in place prior to being fired.

4. The projectile of claim 2 wherein the segmented slip band further comprises three segments.

5. The projectile of claim 2 wherein the sabot assembly further comprises three sabots.

6. The projectile of claim 1 wherein the projectile is sized and dimensioned to be fired from a forty millimeter weapon system.

7. The projectile of claim 1 wherein the payload comprises one or more of the following: steel pellets, tungsten pellets, plastic pellets, rubber pellets, powders, streamers.

8. The projectile of claim 1 wherein the cap is attached to the pusher body by a snap fit.

9. The projectile of claim 8 wherein the sabot assembly does not extend to a front surface of the projectile.

10. The projectile of claim 1 further comprising a rubber pad positioned rear of the payload.

11. The projectile of claim 1 wherein the sabot assembly and the pusher tail each comprise corresponding interface features.

12. The projectile of claim 1 wherein the drag profile of the pusher tail is selected according to a desired payload dispersal distance.

13. The projectile of claim 1 wherein the plunger further comprises a face exposed to the breech of the weapon system and a shaft extending toward the cap such that propulsive gases in the breech act on the face to push the shaft toward the cap to remove the cap.

14. A forty millimeter projectile further comprising:

a pusher assembly further comprising a pusher body defining an interior housing, and a pusher tail connected to the rear of the pusher body;

a pellet payload housed within the pusher body;

a cap snap fit connected to the front of the pusher body for retaining the payload within the pusher body prior to ejection;

a plunger housed within the rear of the pusher body and configured for pushing the cap off the pusher body, said plunger further comprising a face exposed to the breech of the weapon system and a shaft extending toward the cap;

a rubber pad positioned at the rear of the payload;

a sabot assembly coaxial with and partially surrounding the pusher assembly; and a segmented slip band coaxial with and seated in a groove on an exterior of the sabot assembly, wherein the segmented slip band rotates freely within the groove thereby minimizing the spin imparted on the pusher body and the segmented slip band separates into one or more segments upon exit from a weapon system, said segmented slip band further comprising a groove for receiving a corresponding protrusion of a cartridge case to hold the segmented slip band in place prior to being fired.

15. The projectile of claim 14 wherein the segmented slip band further comprises three segments.

16. The projectile of claim 14 wherein the sabot assembly further comprises three sabots.

17. The projectile of claim 14 wherein the sabot assembly does not extend to the cap.

18. The projectile of claim 14 wherein the sabot assembly and the pusher tail each comprise corresponding interface features.

19. The projectile of claim 14 wherein the drag profile of the pusher tail is selected according to a desired payload distance.

* * * * *